United States Patent [19]

Rosenberg

[11] Patent Number: 4,711,399

[45] Date of Patent: Dec. 8, 1987

[54] LIQUID SPRAYING DEVICES

[76] Inventor: Peretz Rosenberg, Moshav Beit Shearim, Israel

[21] Appl. No.: 895,578

[22] Filed: Aug. 13, 1986

Related U.S. Application Data

[63] Continuation of Ser. No. 613,337, May 23, 1984, abandoned.

[30] Foreign Application Priority Data

Jun. 24, 1983 [IL] Israel ..... 69069
Jul. 1, 1983 [IL] Israel ..... 69144
Sep. 7, 1983 [IL] Israel ..... 69680

[51] Int. Cl.[4] ..... B05B 1/26

[52] U.S. Cl. ..... 239/498; 239/499; 239/500; 239/504; 239/506; 239/512; 239/DIG. 1

[58] Field of Search ..... 239/382, 498, 499, 500, 239/504, 506, 512, 514, 515, 518, 524, DIG. 1, 501, 590.5, 590.3

[56] References Cited

U.S. PATENT DOCUMENTS 2,069,150 1/1937 Holder ..... 239/518
2,990,123 6/1961 Hyde ..... 239/499
4,336,908 6/1982 Vikre ..... 239/524
4,347,981 9/1982 Hayes ..... 239/DIG. 1
4,356,974 11/1982 Rosenberg et al. ..... 239/499

FOREIGN PATENT DOCUMENTS 2304408 10/1976 France ..... 239/500

*Primary Examiner*—Andres Kashnikow
*Assistant Examiner*—Michael J. Forman
*Attorney, Agent, or Firm*—Benjamin J. Barish

[57] ABSTRACT

A liquid spraying device comprises a nozzle formed with an outlet orifice through which the water exits as a jet flowing parallel to the axis of the nozzle, a laterally-displaceable cup member supported close to and overlying the outlet orifice so as to be impinged by the jet and to reflect it back towards the nozzle, and a deflector surface in the path of the reflected-back liquid, which deflector surface is formed with a plurality of channels extending generally radially of the nozzle and effective to deflect the reflected-back liquid and to concentrate the spray produced by the cup member along the channels. Described are a static-type device in which the deflector surface is formed in the face of the nozzle having the outlet orifice, and rotary-type devices in which the deflector surface is formed in a rotor mounted between the cup member and the face of the nozzle having the outlet orifice.

6 Claims, 15 Drawing Figures

LIQUID SPRAYING DEVICES

This application is a continuation of application Ser. No. 613,337, filled May 23, 1984, now abandoned.

BACKGROUND OF THE INVENTION

The present invention relates to spray nozzles, and particularly to spray nozzles useful for water irrigation. The invention is especially useful in the type of spray nozzle of U.S. Pat. specification No. 4,356,974 and is therefore described below with respect to this application.

The above-cited patent specification describes a liquid spraying device particularly useful for water irrigation. It comprises a nozzle formed with an outlet orifice through which the liquid issues in the form of a jet, and a jet-impinging member, in the form of a cup, supported close to and in alignment with the nozzle orifice so as to be impinged by the liquid jet issuing therefrom. During use, the water jet issuing through the nozzle orifice impinges against the end wall of the cup-shaped member, producing a water cushion within the member, which water cushion acts to reflect the water back to the face of the nozzle to produce a relatively uniform distribution of water laterally around the nozzle orifice.

SUMMARY OF THE INVENTION

An object or tne present invention is to provide a spray nozzle of the foregoing type, but providing a number of improvements in the respects to be described more particularly below.

According to the present invention, there is provided a water spraying device comprising a nozzle formed with a face having a flat portion and a bore through said flat portion defining an outlet orifice through which the water exits in the form of a jet perpendicularly to said flat portion of the nozzle face. The spraying device further includes a jet-impinging member close to and overlying the flat portion of the nozzle face so as to be impinged by the jet and to reflect same back towards the flat portion of the nozzle face. The jet-impinging member is displaceable laterally with respect to the outlet orifice so as to produce an annular spray of water laterally of the nozzle. The spraying device further includes a deflector surface in the path of the reflected-back water, which deflector surface is formed with a plurality of channels extending generally radially of the nozzle so as to concentrate the lateral spray along said channels. Such an arrangement has been found to increase the range of the spraying device and to permit it to be used with lower line pressures, as well as to decrease wind and evaporation losses.

Two general types of devices in accordance with the invention are described below. One type is a static device in which the deflector surface is formed in the face of the nozzle having the outlet orifice. The other type is a rotary device in which the deflector surface is formed in a rotor rotatably mounted between the cup-shaped member and the face of the nozzle having the outlet orifice.

According to a further feature of the present invention, which may be included in any of the described embodiments, the bore formed through the nozzle extends axially of the nozzle and terminates at one end of the outlet orifice, the opposite end of the nozzle being formed with a plurality of axially-extending inlet bores disposed laterally of the longitudinal axis of the outlet orifice, each of the inlet bores underlying a portion of the outlet orifice but terminating short of the end of the housing formed with the outlet orifice, and communicating with the outlet orifice by a radially-extending passageway therebetween.

It has been found that spraying devices constructed in accordance with the foregoing features provide a number of important advantages over the previously known spraying devices, particularly those described in the above-cited patent specification. One important advantage is that by forming the nozzle face with the channels to channel the liquid (water) to form distinct sub-jets, the range of the spraying device is substantially increased, thereby permitting the spraying device to be used with a line pressure even lower than that of the spraying device described in the above-cited patent specification. This substantially lower the energy costs, and in some cases even obviates the need for a pump. Moreover, this arrangement also reduces wind and evaporation losses. Further, the channels formed on the face of the nozzle can be used to produce unsymmetrical distributions laterally of the spraying device, for example, to provide unwetted zones along an edge or corner of an area to be irrigated. Still further, the devices have a low sensitivity to clogging .

Further features and advantages of the invention will be apparent from the description below.

BRIEF DESCRIPTION OF THE DRAWINGS

The invention is herein-described, by way of example only, with reference to the accompanying drawings, wherein.

DESCRIPTION OF REFERRED EMBODIMENTS

Figure 1:
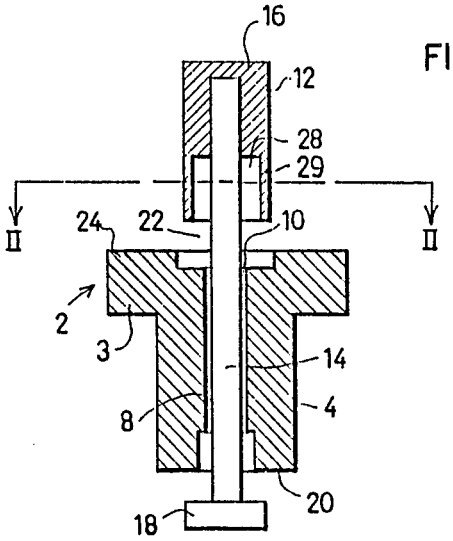
FIG. 1 is a longitudinal sectional view illustrating a static spraying device constructed in accordance with the present invention.
Figure 2:
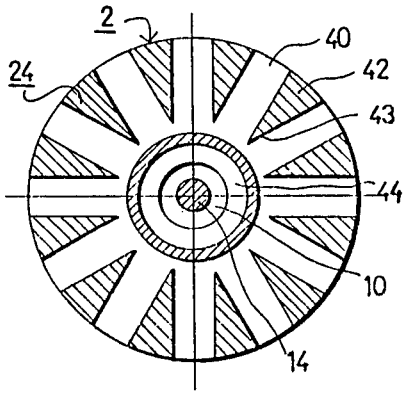
FIG. 2 is a sectional view along lines II-II of FIG. 1, particularly illustrating the upper face of the nozzle.

The sprayrng device illustrated in FIGS. 1 and 2 is an irrigation device of the general type described in the above-cited specification. It includes a nozzle, generally designated 2, formed with an upper head 3 and a lower conical end 4 for attachment, e.g., by a friction-fit, to a water supply device (not shown). Nozzle 2 is formed with an axial bore 8 communicating at one end (the lower end) with the water supply pipe, and terminating at the opposite end in an outlet orifice 10 through which the water issues in the form of a jet.

A cup-shaped member 12 is supported close to and in alignment with nozzle orifice 10 so as to be impinged by the jet issuing from the orifice. The cup-shaped member 12 includes a central opening 28 defined by a thin side wall 29, and is floatingly mounted by means of a rod 14 passing through nozzle bore 8. Rod 14 is of smaller diameter, and of greater length, than the nozzle bore, and its outer end is secured, e.g., by a friction fit, centrally of the end wall 16 of the cup-shaped member 12. The opposite end of rod 14 is formed with a crossbar 18 of greater length than the diameter of the respective end of bore 8 so as to limit against the lower face 20 of the nozzle.

As described in the above-cited patent specification, the rod 14 provides a floating mounting for the cup-shaped member 12, permitting the latter member to move in a lateral direction with respect to the nozzle orifice 10, and also in an axial direction towards and away from the nozzle orifice. The movement of the cup-shaped member 12 away from the nozzle orifice is effected by the water jet during use, and is limited by crossbar 18 engaging face 20 of the nozzle, which produces an annular space 22 between the edge of the cup-shaped member 12 and the confronting face 24 of the nozzle. As described in that patent specification, the water jet forms a water cushion within the cup-shaped member 12, which cushion reflects the water back to the upper face 24 of the nozzle and propells same laterally across that face. In that patent specification, this upper face 24 is substantially flat, so that the laterally-propelled water follows the flat surface of the nozzle and thereby produces a substantially uniform annular spray of water around the nozzle, but may be formed with an upwardly inclined outer surface to produce an upwardly inclined spray of the water around the nozzle.

According to the present, invention, nozzle face 24 around its orifice 10 is not flat, but rather is formed with a plurality of channels 40 extending generally in the radial direction to the outer edge of the nozzle. The construction is such that the jet of water issuing from orifice 10, and reflected by the water cushion formed within cup 12 back to nozzle face 24, is channeled to form a plurality of sub-jets as it is propelled laterally of the nozzle.

More particularly, and as seen especially in FIG. 2, the channels 40 are produced by forming radially-extending grooves around the central orifice 10, which grooves are separated by triangular segments 42. The inlet ends of the channels 40, as defined by the apices 43 of the triangular segments 42, are spaced slightly outwardly from the nozzle orifice 10 and from the outer edge of side wall 29 of the cup-shaped member 12, so as to define an annular, flat, unchanneled surface 44 around the nozzle orifice 10, which annular surface 44 is engaged by the side wall 29 of the cup-shaped member 12 during non-use of the spraying device.

Thus, when the spraying device is not used, the cup-shaped member 12 drops by gravity against the flat annular surface 44 of the nozzle 2, thereby covering the nozzle orifice 10 and preventing the entry of foreign particles, such as dirt, insects, or the like. When the water supply is turned on, the water jet issuing through the nozzle orifice 10 impinges against the end wall 16 of the cup-shaped member 12, producing a water cushion within the member and moving the member outwardly until the crossbar 18 of rod 14 limits against face 20 of the nozzle. The water jet issuing from orifice 10 thus produces a water cushion within the cup-shaped member 12, and within the annular space 22 between member 12 and face 24 of the nozzle. This water cushion reflects the water jet issuing from nozzle orifice 10 back to nozzle face 24, causing the water to follow the shape of that face as the water is propelled in the lateral direction. Since in this case nozzle face 24 is formed with the channels 40, the laterally propelled water is thus channeled to form a plurality of sub-jets, each defined by one of the radiating channels 40, so that the water spray issuing laterally of the nozzle is thus concentrated or "bunched" into sub-jets rather than being in the form of uniformly distributed drops. As indicated earlier, this distribution of the water in the form of sub-jets substantially increases the range of the spraying device, and thereby permits the spraying device to be used with substantially lower line pressures for any given range; moreover, it decreases wind and evaporation losses.

Channels 40 formed in face 24 of the spray nozzle illustrated in FIGS. 1 and 2 are symmetrically disposed around the face of the nozzle and thereby produce a symmetrical distribution of the water sub-jets laterally around the spraying device. However, another advantage of the invention is that it conveniently permits unsymmetrical distribution of the water to be produced. For example, the outer edge or corner of an area to be sprayed may be left dry or unwetted, if desired.

Figure 3:
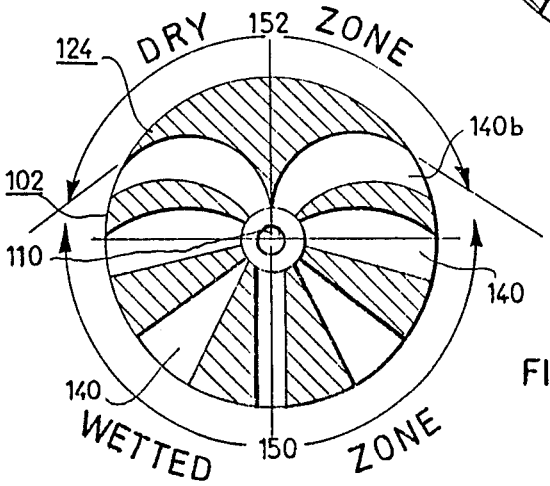
FIG. 3 is a top-plan view illustrating the upper face of a modified form of nozzle in accordance with the present invention.

Thus, FIG. 3 illustrates one form of unsymmetrical disposition of the channels, therein designated 140, on face 124 of the spraying nozzle 102. In this illustrated form, substantially one-half of face 124 of the spray nozzle is formed with symmetrically radiating channels **140*a* as in the FIGS. 1–2 embodiment, this portion of the nozzle face producing a symmetrically wetted zone as shown at 150 in FIG. 3. The remaining one-half of face 124, however, is formed with other channels, designated 140*b*, shaped so as to produce a dry zone 152** during use of the spraying device.

In the illustrated arrangement, channels **140*b* also start at or near the center nozzle orifice 110, but curve as they progress towards the outer face of the nozzle so as to thereby curve the sub-jets passing through these channels. Thus, when the sub-jets channeled by the curved channels 140*b* exit from the outer face of the nozzle 102, they have been very substantially turned from the radial direction to or towards the tangential direction, to thereby produce the dry zone 152**.

It will thus be seen that by proper shaping of the channels on the outer face of the nozzle, many different water distribution patterns may be produced as desired.

While the channels 140 in FIG. 3 are illustrated as starting from the nozzle orifice 110, it will be appreciated that they could start at points spaced outwardly from the nozzle so as to provide the annular flat margin (44 in FIG. 2) around the orifice engageable by the side walls of the cup-shaped member, in order to completely close off the orifice during the non-use of the spray nozzle, as described above with respect to the embodiment of FIGS. 1 and 2.

Figure 5:
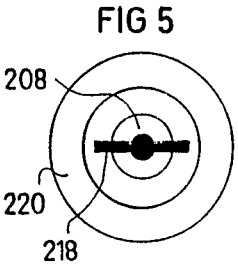
FIG. 5 is a bottom-plan view of the sprinkler of FIG. 4.
Figure 4:
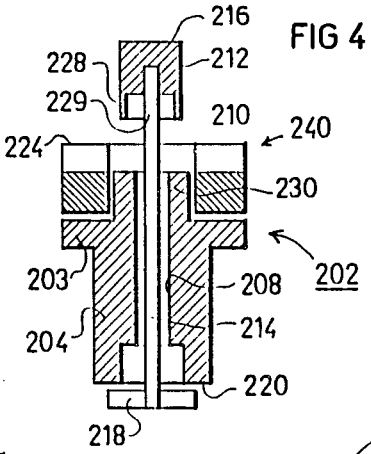
FIG. 4 is a longitudinal sectional view illustrating one form of rotary water sprinkler constructed in accordance with the present invention.
Figure 6:
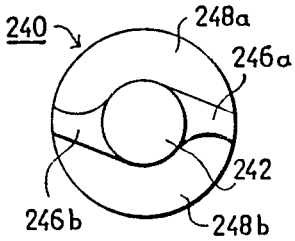
FIG. 6 is a top-plan view illustrating the rotor in the sprinkler of FIGS. 4 and 5.

The sprinkler illustrated in FIGS. 4–6 of the drawings includes a nozzle, generally designated 202, formed with an upper head 203 and a lower conical end 204 for attachment, e.g. by a friction-fit, to a water supply device (not shown). Nozzle 202 is formed with an axial bore 208 communicating at one end (the lower end) with the water supply pipe, and terminating at the opposite end in an outlet orifice 210 through which the water issues in the form of an axially-flowing jet.

A cup-shaped member 212, is supported close to and in alignment with nozzle orifice 210 so as to be impinged by the jet issuing from the orifice. Cup 212 is floatingly mounted by means of a rod 214 passing through nozzle bore 208. Rod 214 is of smaller diameter and of greater length than the nozzle bore, and its outer end is secured by a friction fit centrally of the end wall 216 of cup 212. The opposite end of rod 214 is formed with a crossbar 218 of greater length than the diameter of the respective end of bore 208 so as to limit against the lower face 220 of the nozzle.

It will thus be seen that rod 214 provides a floating mounting for cup 212, permitting the latter to move in a lateral direction with respect to the nozzle orifice 210, and also in an axial direction towards and away from the nozzle orifice. The axially-flowing water jet issuing from orifice 210 flows through the open end of cup 212 and forms a water cushion within it, which cushion reflects the water back towards the upper face 224 of the nozzle. The foregoing structure and operation are clearly described in the above-cited patent specification, wherein it is also brought out that the side wall 229 of cup 212 is very thin, having a thickness which is a small fraction of the diameter of its opening 228.

In the above-cited patent specification, the surface of the nozzle facing the cup is flat and produces a lateral spray of the water around it. In the present invention, however, a rotor, generally designated 240, is rotatably mounted between cup 212 and the nozzle 202, and is formed on its surface facing the cup with at least one channel effective to constrain the water reflected back from the cup towards the nozzle, to form at least one laterally-flowing jet, and also to rotate the rotor and thereby the laterally-flowing jet. In the arrangement illustrated in FIGS. 4–6, the rotor 240 is formed with two such conduits to produce two laterally-flowing jets which are rotated during the operation of the sprinkler.

More particularly, nozzle 202 is formed with a cylindrical hub 230 on the surface facing cup 212, which hub is of larger outer diameter than the outer diameter of the cup. Rotor 240 is formed with a central bore 242 of a diameter to be rotably received over hub 230. The upper surface of rotor 240 facing cup 212 is formed with two recessed channels **246*a*, 246*b*, separated by high regions 248*a*, 248*b*, which channels extend generally in the radial direction from bore 242 to the outer surface of the rotor. These channels are not exactly uniform or radial but rather are larger at their inner ends than at their outer ends, and are given a curvature in the tangential direction, so that when they receive the water reflected back from cup 21**, they will apply a rotary motion to the rotor.

The rotary sprinkler illustrated in FIGS. 4–6, thus operates as follows:

First, when the sprinkler is not operating, cup 212 drops by gravity onto the confronting flat face of the nozzle hub 230, thereby closing orifice 210 and preventing the entry of dirt, insects, or the like.

During operation of the sprinkler, the water flowing through bore 208 of the nozzle exits from orifice 210 in the form of a jet and impinges cup 212, thereby forming a water cushion within the cup, which water cushion reflects back the water towards nozzle hub 230. The water reflected back to the upper face of hub 230 follows the configuration of that face, which is flat, and therefore moves laterally towards rotor 240. The high regions **248*a*, 248*b*, on the rotor 240 block the flow of the water to these regions and constrain the water to flow through the channels 246*a*, 246*b* of the rotor. Since these channels are wide at their inner ends converging towards their outer ends, and are curved somewhat in the tangential direction, the water flowing through these channels applies a rotary moment to the rotor 240, thereby causing the rotor to rotate on hub 230** of the nozzle.

It will thus be seen that the water issuing from the sprinkler illustrated in FIGS. 4–6 will be in the form of two diametrically-opposed jets which rotate with the rotation of the rotor 240.

Figure 7:
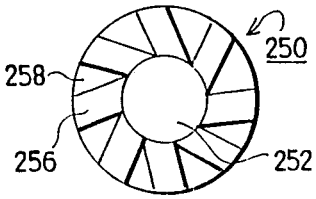
FIGS. 7 and 8 are top-plan and side elevational views, respectively, illustrating another rotor which may be used.
Figure 8:
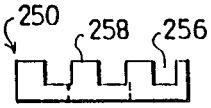

FIGS. 7 and 8 illustrate another rotor, therein designated 250, which may be used in the sprinkler of FIGS. 4–6 for producing eight rotating jets, rather than two. Thus, rotor 250 is also formed with a central bore 252 and with eight channels 256 se separated by eight high regions 258 symmetrically disposed about the center of the rotor, which channels also progress generally in the radial direction but are turned slightly tangentially in order to apply a rotary moment to the rotor.

It will be appreciated that the rotor could be formed with only one such channel, in which case the sprinkler would produce one rotating laterally-flowing jet, or could include any other number of channels to produce another desired number of jets.

Figure 9:
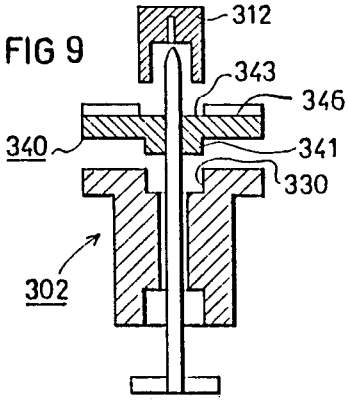
FIG. 9 is an exploded longitudinal sectional view illustrating another form of rotary sprinkler constructed in accordance with the invention.

FIG. 9 illustrates another variation wherein the nozzle, therein designated 302, is formed with a cylindrical socket 330 for rotatably supporting the rotor, therein designated 340, the latter being formed with the cylindrical hub 341 rotatably mounted within socket 350. The opposite face of rotor 340 is formed with the channels 346, but in this case the channels do not start at the central bore 342 of the rotor, but rather from points spaced outwardly from the bore so as to provide a flat, unchanneled surface 343 facing the cup 312. Thus, the water reflected back by the water cushion formed within the cup impinges the flat surface 343 of the rotor 340 (rather than the flat surface 224 of the nozzle hub 230 in the FIGS. 4–6 arrangement). The water is then constrained by the channels 346 to form the laterally-flowing jets and to apply a rotary moment to the rotor, as in the FIGS. 4–6 arrangement.

Figure 11:
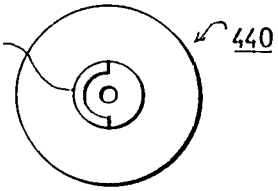
FIG. 11 is a top-plan view illustrating the rotor in the sprinkler of FIG. 10.
Figure 10:
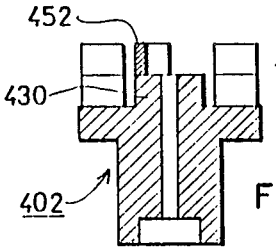
FIG. 10 is a longitudinal sectional view illustrating the nozzle and rotor in a further form of rotary sprinkler constructed in accordance with the invention.
Figure 12:
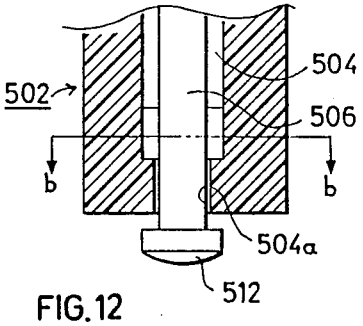
FIG. 12 is a fragmentary sectional view illustrating a modification in the inlet end of the nozzle to prevent clogging.
Figure 13:
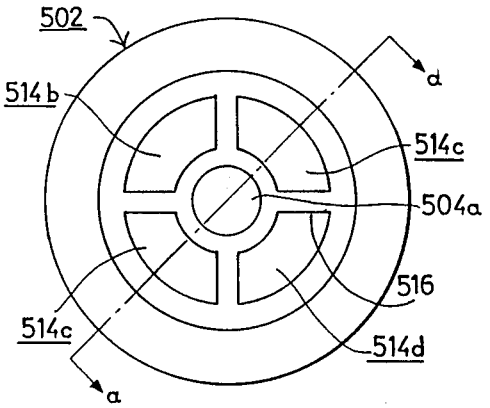
FIG. 13 is a bottom plan view of the modification of FIG. 12.
Figure 15:
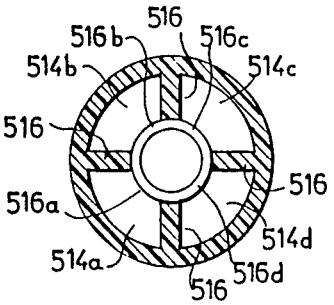
FIG. 15 is a sectional view along lines b--b of FIG. 12 with the spindle removed.
Figure 14:
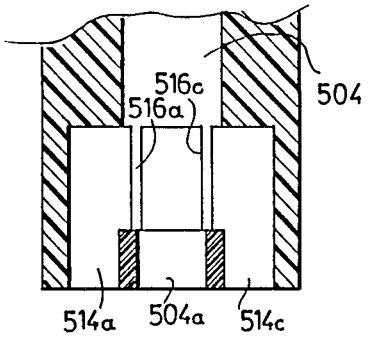
FIG. 14 is a sectional view along lines a--a of FIG. 13.

FIGS. 10 and 11 illustrate another variation of rotary sprinkler in accordance with the invention. Thus, in the arrangement illustrated in FIGS. 10 and 11, the rotor 440 may be of the same construction as described above with respect to rotor 240 in FIGS. 4–6, but in this case, the hub 430 on nozzle 402, which hub rotatably receives the rotor 440, is shaped so as to produce an unsymmetrical distribution of the water to the rotor. Thus, as shown in FIGS. 10 and 11, hub 430 is formed with a semicircular blocking wall 452 at one side, to block the water from flowing to the respective side of the rotor 440. Semicircular wall 452 is of larger diameter than the opening in the cup (not shown), so that the water reflected back from the cup will impinge the nozzle inwardly of this wall. In such an arrangement, the laterally-flowing jets (or jet) produced by the sprinkler will rotate only for 180°, rather than for 360° in the previously described embodiments. Thus, the rotary sprinkler illustrated in FIGS. 10 and 11 may be used where it is desired to keep one side of the sprinkler unwetted, such as along one edge of a land section to be irrigated.

It will be appreciated that this face of nozzle hub 430 may take other configurations to produce other water distribution patterns, as desired, and that the channels formed in the rotor could be inclined upwardly to incline the laterally-flowing jets.

FIGS. 12–15 illustrate a modification in the inlet end of the nozzle which may be incorporated in any of the above-described devices to lessen the possibility of clogging by foreign particles. Thus, these figures illustrate only the lower part of the head or housing wherein the inlet end 504*a* of the bore 504 does not serve as the inlet to the irrigation device, but rather serves merely as a mounting for the spindle 506. Accordingly, this end 504*a* may be of substantially the same diameter as that of the spindle, preferably slightly larger to permit the spindle to freely move axially within the bore. In addition, the respective end of the spindle 506 is provided with an annular head 512 which is of only slightly larger diameter than that of the spindle, sufficient to overlie the edges of bore 504*a* so as to limit the outward movement of the spindle.

The inlet into the device is constituted of a plurality of axially-extending inlet bores 514*a*–514*d* formed in the inlet side of housing 502 and disposed laterally of the longitudinal axis of the outlet bore 504, and also laterally of the annular area occupied by head 512 of spindle 506 when the latter is inserted within the bore. As shown particularly in FIGS. 13 and 15, these axially extending inlet bores 514*a*–514*d* are disposed in a circular array around the longitudinal axis of bore 504, and are separated from each other by thin separator webs 516.

Inlet bores 514*a*–514*d* extend axially through the housing sufficient to underlie the lower end of the enlarged diameter portion of bore 504, but terminate considerably short of the opposite end of the housing, containing the outlet orifice (not shown). Each of these inlet bores 514*a*–*514d* communicates with bore 504*a* by a radially-extending passageway 516*a*–516*d*, respectively.

It will thus be seen that when housing 502 is connected to a pressurized water supply line, as by applying a connector to the outer face of the housing, the water is inletted into the housing, not through bore 504*a*, as in the conventional construction, but rather through the axially-extending blind bores 514*a*–514*d*. The water travels axially through the blind bores, then radially through the passages 516*a*–516*d* to bore 504, and then axially through that bore, issuing from the outlet end 504*b* thereof in the form of an annular jet, as described above.

It will be seen that the illustrated construction including the four axially-extending inlet bores 514*a*–514*d*, provide a number of important advantages over the conventional construction. Thus, since these inlet bores 514*a*–514*d* have a substantially larger surface area than in the conventional construction (they cover substantially the complete end face of the housing except for the separator webs 516 and the annular rim of the housing), the device has a much lower sensitivity to clogging by foreign particles in the water. Moreover, since the spindle head 512 may be of annular configuration, rather than of the crossbar configuration of the conventional construction, and also since this head may have a diameter only slightly greater than the diameter of the spindle itself, the spindle is permitted to pivot during the operation of the sprinkler along all the axes perpendicular to the spindle's longitudinal axis, thereby providing a much improved floating action of the spindle and of the cup (not shown) carried thereby, which produces a better distribution of the water around the irrigation device. In addition, the impacting of spindle head 512 against the respective face of housing 502 is not concentrated in a restricted area, but rather is distributed around the end face of the housing, thereby extending the useful life of the device.

While the invention has been described with respect to several preferred embodiments, it will be appreciated that many other variations, modifications, and applications of the invention may be made.

What is claimed is:

1. A nozzle connectible to a source of pressurized water and having a face formed with a bore defining an outlet orifice through which the water exits in the form of a jet perpendicularly to the nozzle face; a deflector member mounted close to and overlying said nozzle face and having a recess whose outer edge circumscribes the nozzle bore such that the deflector member is impinged by said jet and reflects same back towards said nozzle face;

said deflector member being mounted on a rod passing through the nozzle orifice and displaceable laterally and axially with respect to said outlet orifice so as to produce a lateral spray of water around the outlet orifice;

said nozzle face having said bore being formed with a plurality of channels extending generally radially of said nozzle to concentrate said lateral spray along said channels, said channels being defined by a plurality of triangular segments having apices spaced outwardly from said nozzle orifice and from the overlying outer edge of the recess of the deflector member so as to define an annular, flat, unchanneled surface underlying the recess of the deflector.

2. The device according to claim 1, wherein said bore formed through said nozzle extends axially of the nozzle and terminates at one end of the outlet orifice, the opposite end of said nozzle being formed with a plurality of axially-extending inlet bores disposed laterally of the longitudinal axis of the outlet orifice, each of said inlet bores underlying a portion of the outlet orifice but terminating short of the end of the housing formed with said outlet orifice, and communicating with said outlet orifice by a radially-extending passageway therebetween.

3. The device according to claim 2, wherein said inlet bores are disposed in a circular array around the longitudinal axis of said outlet orifice and are separated from each other by a thin radially-extending web.

4. The device according to claim 1, wherien said deflector member is cup-shaped having a diameter less than that of said face of the nozzle having said bore and a thickness which is a fraction of the diameter of its open end, one end of sid rod being attached to the center of the cup-shaped member, the opposite end of said rod including a stop limiting the outward movement of the rod and of the cup-shaped member with respect to the nozzle.

5. The spraying device according to claim 1, wherein said channels are symmetrically disposed around said face of the nozzle to produce a symmetrical distribution of sub-jets laterally of the nozzle.

6. The spraying device according to claim 1, wherein said channels are unsymmetrically disposed around said face of the nozzle to produce an unsymmetrical distribution of sub-jets laterally of the nozzle.

* * * * *